US009815301B2

(12) United States Patent
Maesaka

(10) Patent No.: US 9,815,301 B2
(45) Date of Patent: Nov. 14, 2017

(54) INKJET PRINTER

(71) Applicant: RISO KAGAKU CORPORATION, Tokyo (JP)

(72) Inventor: Toshihide Maesaka, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/270,686

(22) Filed: Sep. 20, 2016

(65) Prior Publication Data

US 2017/0087881 A1 Mar. 30, 2017

(30) Foreign Application Priority Data

Sep. 30, 2015 (JP) ..... 2015-193073

(51) Int. Cl.

| | |
|---|---|
| ***B41J 11/00*** | (2006.01) |
| ***B41J 2/01*** | (2006.01) |
| ***B41J 2/17*** | (2006.01) |
| ***B41J 13/10*** | (2006.01) |

(52) U.S. Cl.

CPC ..... *B41J 11/0045* (2013.01); *B41J 2/01* (2013.01); *B41J 2/1714* (2013.01); *B41J 13/106* (2013.01); *B41J 2202/21* (2013.01)

(58) Field of Classification Search

CPC .... B41J 11/0085; B41J 11/007; B41J 11/0045
See application file for complete search history.

(56) References Cited

U.S. PATENT DOCUMENTS

| | | | | |
|---|---|---|---|---|
| 4,802,497 A * | 2/1989 | Hrboticky | ..... | A24C 5/392 131/108 |
| 6,045,278 A * | 4/2000 | Kubatzki | ..... | B41J 11/0085 101/93 |
| 6,981,766 B2 * | 1/2006 | Tsuji | ..... | B41J 11/0065 226/95 |

(Continued)

FOREIGN PATENT DOCUMENTS

| | | |
|---|---|---|
| EP | 2402166 | 4/2012 |
| JP | 2009-234073 A | 10/2009 |

OTHER PUBLICATIONS

Extended European Search Report, European Patent Application No. 16190575.7, Sep. 5, 2017 (8 pages).

*Primary Examiner* — Stephen Meier
*Assistant Examiner* — John P Zimmermann
(74) *Attorney, Agent, or Firm* — Hamre, Schumann, Mueller & Larson, P.C.

(57) ABSTRACT

An inkjet printer includes: a printing unit including an inkjet head and configured to eject an ink from the inkjet head while conveying a sheet in a conveying direction along a printing route to perform printing on the sheet; and a downstream side conveyor arranged downstream of the printing unit in the conveying direction and including a guide defining a downstream conveyance route being a space for the sheet to be conveyed. The downstream side conveyor is configured to convey the sheet along the downstream conveyance route. The downstream side conveyor includes an adjustment member narrowing a flow passage of air in the downstream conveyance route. The guide includes communication holes communicating the downstream conveyance route with a space outside the printing route and outside the downstream conveyance route.

14 Claims, 12 Drawing Sheets

(56) References Cited

U.S. PATENT DOCUMENTS

| | | | | |
|---|---|---|---|---|
| 2003/0121604 | A1* | 7/2003 | Keil | B32B 37/0007 156/286 |
| 2005/0122372 | A1* | 6/2005 | Shimizu | B41J 11/007 347/22 |
| 2007/0291096 | A1* | 12/2007 | Toyoshima | B41J 11/0025 347/104 |
| 2009/0244242 | A1* | 10/2009 | Sawada | B41J 11/0085 347/104 |
| 2009/0244247 | A1* | 10/2009 | Yamamoto | B41J 11/007 347/104 |
| 2011/0221845 | A1 | 9/2011 | Ue | |
| 2013/0027465 | A1 | 1/2013 | Yamamoto et al. | |
| 2013/0050375 | A1* | 2/2013 | Ishimori | B41J 11/06 347/104 |

* cited by examiner

INKJET PRINTER

CROSS REFERENCE TO RELATED APPLICATION

This application is based upon and claims the benefit of priority from the prior Japanese Patent Application No. 2015-193073, filed on Sep. 30, 2015, the entire contents of which are incorporated herein by reference.

BACKGROUND

1. Technical Field

The disclosure relates to an inkjet printer which performs printing by ejecting inks from inkjet heads.

2. Related Art

An inkjet printer is known which performs printing by ejecting inks from fixed inkjet heads to a sheet while conveying the sheet.

In such an inkjet printer, ink mist is generated around the inkjet heads due to the ejection of the inks from the inkjet heads. The ink mist is carried downstream by an air flow generated by the conveyance of the sheet, and contaminates members such as guide plates which guide the sheet. Accordingly, there is a risk that the printed sheet comes into contact with the members contaminated by the ink mist and is smeared.

Japanese Patent Application Publication No. 2009-234073 proposes an inkjet printer including: fans attached to a belt roller configured to rotate a conveyor belt of a conveyor which conveys a sheet; and an ink mist processor having a duct and a filter.

In printing by this inkjet printer, the ink mist is sucked into the duct of the ink mist processor by the fans rotating together with the belt roller, and then is caught by the filter. This can reduce the ink mist adhering to guide plates downstream of the conveyor and reduce smears on printed sheets.

SUMMARY

Since the inkjet printer of Japanese Patent Application Publication No. 2009-234073 is provided with the fans and the ink mist processor for collecting the ink mist, the size of the apparatus is large.

An object of the discloser is to provide an inkjet printer which can reduce smears on printed sheets with an increase in size of the apparatus being suppressed.

An inkjet printer in accordance with some embodiments includes: a printing unit including an inkjet head and configured to eject an ink from the inkjet head while conveying a sheet in a conveying direction along a printing route to perform printing on the sheet; and a downstream side conveyor arranged downstream of the printing unit in the conveying direction and including a guide defining a downstream conveyance route being a space for the sheet to be conveyed. The downstream side conveyor is configured to convey the sheet along the downstream conveyance route. The downstream side conveyor includes an adjustment member narrowing a flow passage of air in the downstream conveyance route. The guide includes communication holes communicating the downstream conveyance route with a space outside the printing route and outside the downstream conveyance route.

The configuration described above can reduce the air velocity of an air flow in the printing route to reduce the generation amount of the ink mist and also suppress a flow of the ink mist into the downstream conveyance route. As a result, it is possible to reduce the ink mist adhering to the guide and thereby reduce smears on printed sheets. Moreover, since there is no need to provide a mechanism for collecting the ink mist such as a fan, an increase in size of the apparatus can be suppressed. Accordingly, the configuration described above can reduce smears on printed sheets with an increase in size of the apparatus being suppressed.

The communication holes may be arranged downstream of the adjustment member in the conveying direction.

In the configuration described above, a large amount of air flows into the downstream conveyance route from the outside space and this reduces the amount air which contains a large amount of ink mist and which flows into the downstream conveyance route from the printing route. As a result, it is possible to further reduce the ink mist flowing into the downstream conveyance route. Hence, smears on printed sheets can be further reduced.

The inkjet head may include a plurality of head modules. A communication hole of the communication holes located closer to the plurality of head modules in the conveying direction than the other communication hole may have a larger opening area than an opening area of the other communication hole.

In the configuration described above, it is possible to further suppress the flow of the ink mist into the downstream conveyance route. Hence, smears on printed sheets can be further reduced.

The adjustment member may extend in a direction orthogonal to the conveying direction to reduce an area of an opening cross section of the downstream conveyance route taken in the direction orthogonal to the conveying direction.

The inkjet head may be a fixed inkjet head.

DETAILED DESCRIPTION

Figure 1:
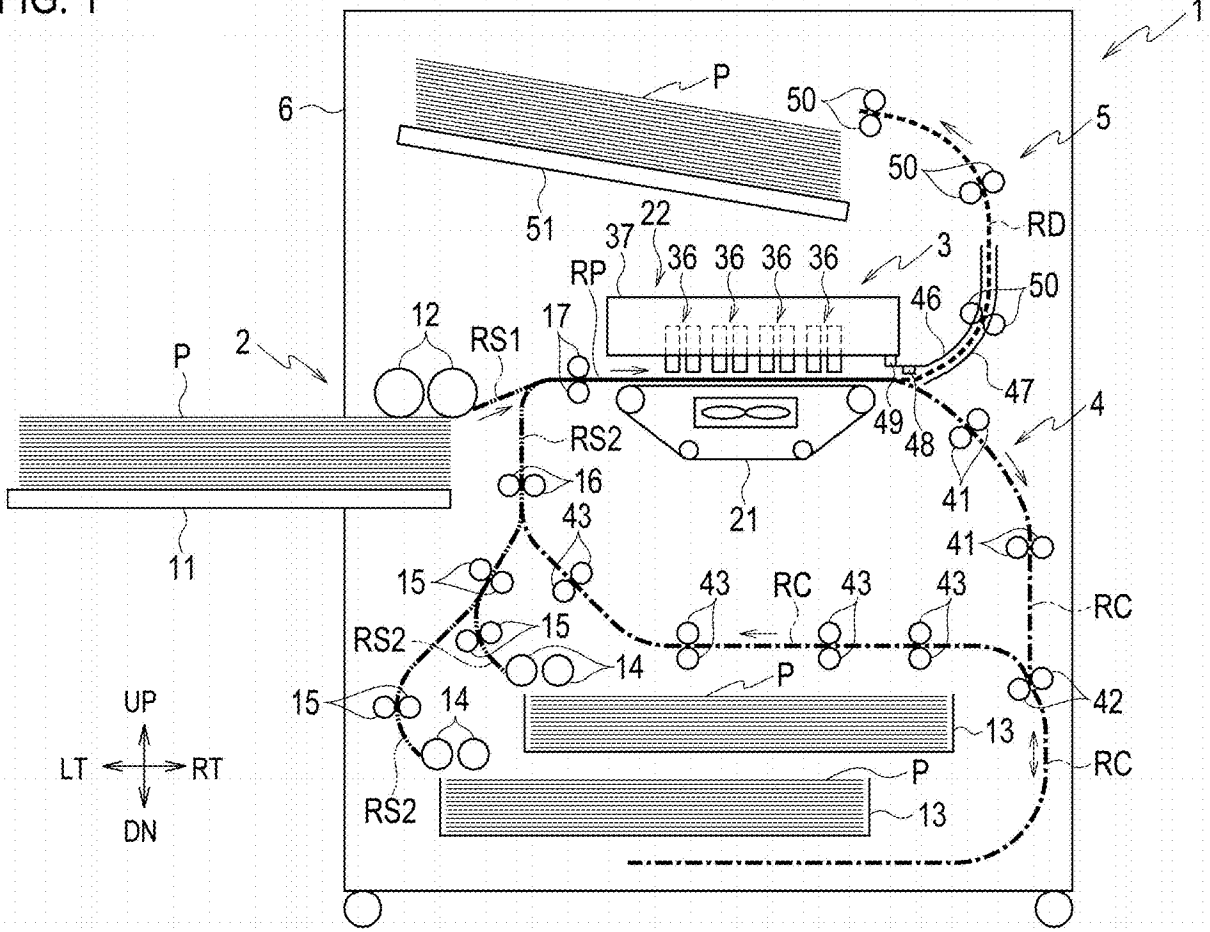
FIG. 1 is a schematic configuration diagram of an inkjet printer in a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
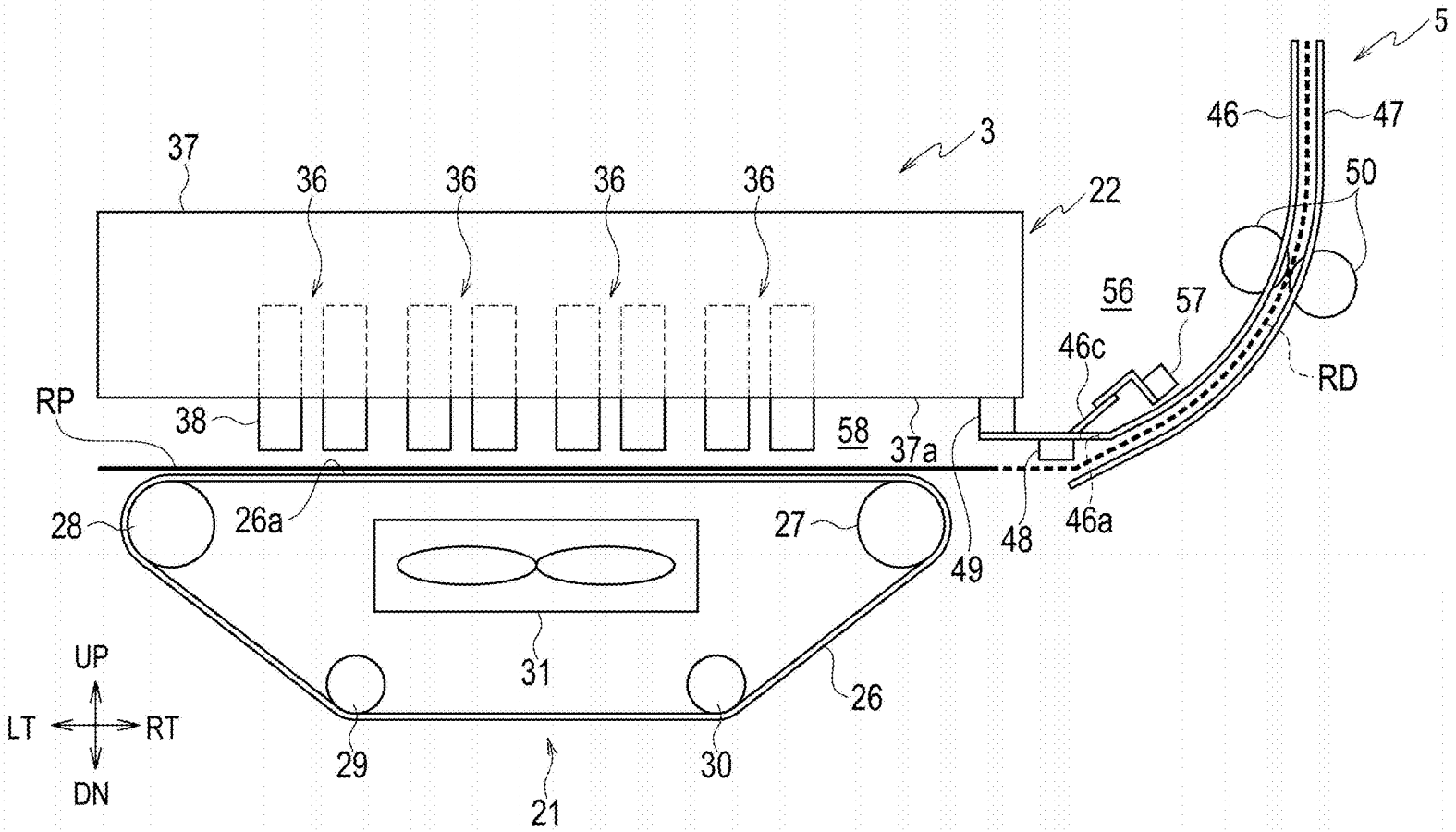
FIG. 2 is a partially enlarged view of a printing unit and a sheet discharger in the inkjet printer illustrated in FIG. 1.
Figure 3:
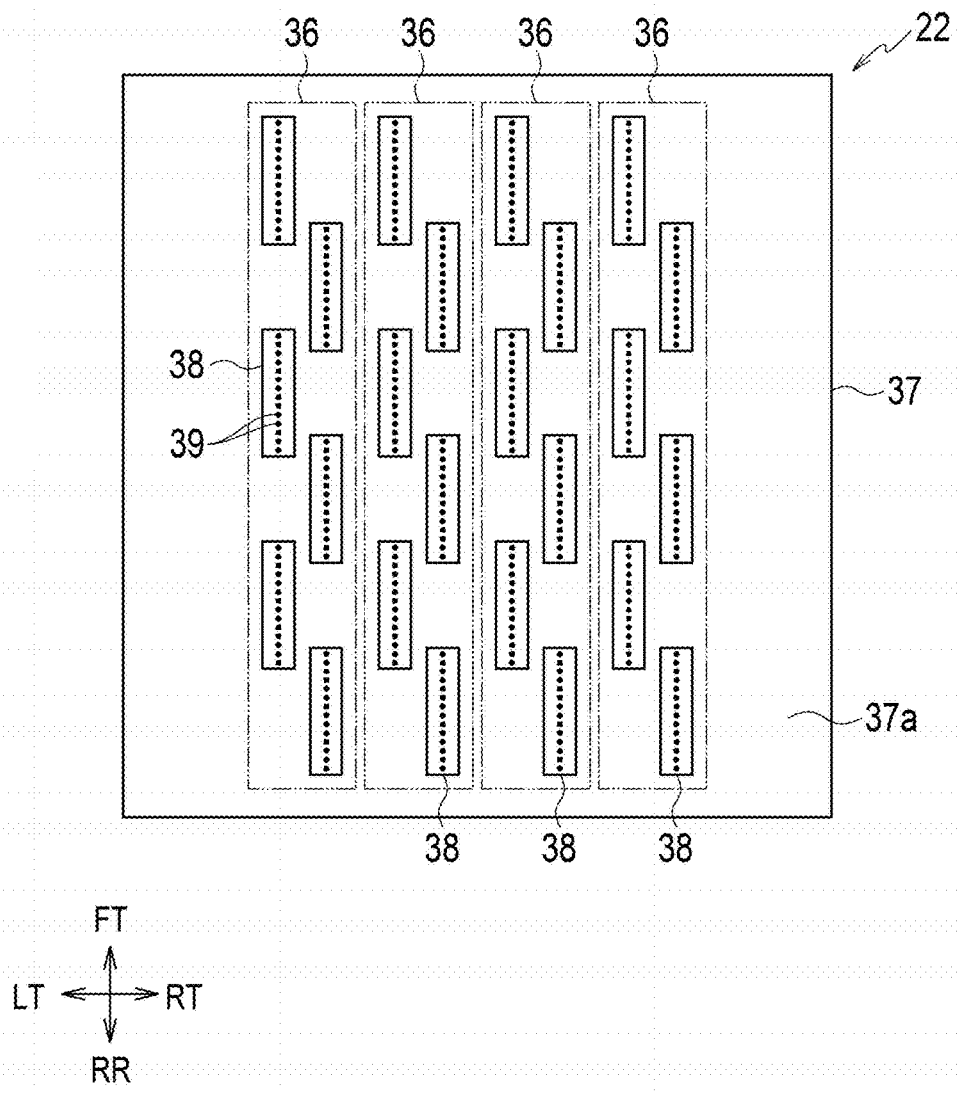
FIG. 3 is a bottom view of a head unit of the inkjet printer illustrated in FIG. 1.
Figure 4:
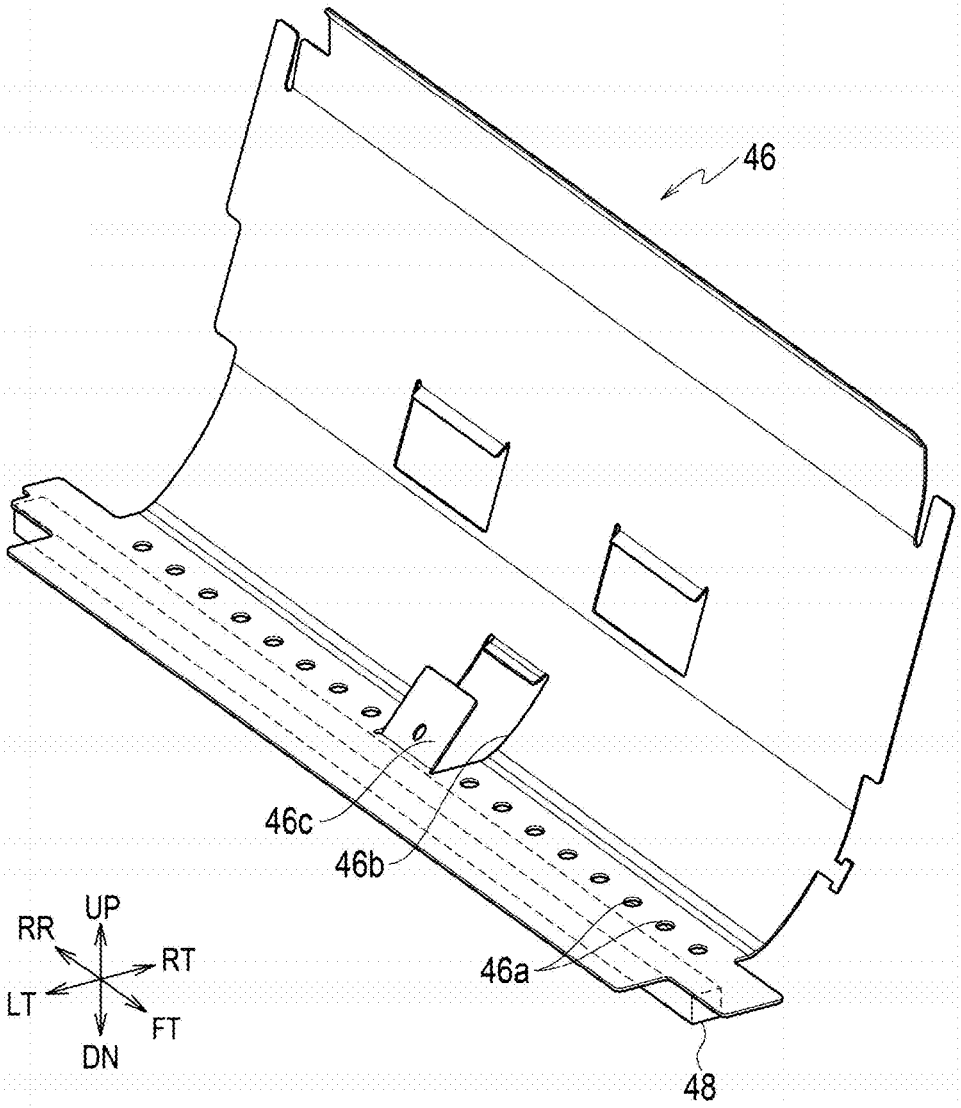
FIG. 4 is a perspective view of an inner sheet discharge guide plate of the sheet discharger in the inkjet printer illustrated in FIG. 1.

FIG. 1 is a schematic configuration diagram of an inkjet printer in a first embodiment of the present invention. FIG. 2 is a partially enlarged view of a printing unit and a sheet discharger in the inkjet printer illustrated in FIG. 1. FIG. 3 is a bottom view of a head unit of the inkjet printer illustrated in FIG. 1. FIG. 4 is a perspective view of an inner sheet discharge guide plate of the sheet discharger in the inkjet printer illustrated in FIG. 1. In FIGS. 1 to 7, 10, and 11, a rightward direction, a leftward direction, an upward direction, a downward direction, a forward direction, a rearward direction, a sheet conveying direction, a sheet width direction are denoted by RT, LT, UP, DN, FT, RR, TD, and WD respectively.

Routes illustrated by bold lines in FIG. 1 are conveying routes through which a sheet being a print medium is conveyed. Out of the conveying routes, a route illustrated by a solid line is a printing route RP, a route illustrated by a one-dot chain line is a circulation route RC, a route illustrated by a broken line is a sheet discharge route RD, routes illustrated by two-dot chain lines are an external sheet feed route RS1 and an internal sheet feed route RS2. Upstream and downstream referred to in the following description mean upstream and downstream in the conveying routes.

As illustrated in FIG. 1, the inkjet printer 1 of the first embodiment includes a sheet feeder 2, a printing unit 3, a circulation conveyor 4, a sheet discharger 5, and a case 6 housing or holding the aforementioned units.

The sheet feeder 2 feeds unprinted sheets P to the printing unit 3. Moreover, the sheet feeder 2 refeeds the sheets P printed on one sides to the printing unit 3 in both-side printing. The sheet feeder 2 is arranged upstream of all the other units in the conveying route. The sheet feeder 2 includes an external sheet feed tray 11, external sheet feed rollers 12, two internal sheet feed trays 13, two pairs of internal sheet feed rollers 14, three pairs of internal sheet feed conveyance rollers 15, vertical conveyance rollers 16, and registration rollers 17.

The external sheet feed tray 11 is a tray on which the sheets P used for printing are stacked. The external sheet feed tray 11 is installed to be partially exposed to the outside of the case 6.

The external sheet feed rollers 12 pick up the sheets P stacked on the external sheet feed tray 11 one by one, and convey the sheets P to the registration rollers 17.

The internal sheet feed trays 13 are trays on which the sheets P used for printing are stacked. The internal sheet feed trays 13 are arranged inside the case 6.

The pairs of internal sheet feed rollers 14 each pick up the sheets P stacked on a corresponding one of the internal sheet feed trays 13 one by one and conveys the sheets P to the internal sheet feed conveyance rollers 15.

The internal sheet feed conveyance rollers 15 convey the sheets P picked up from the internal sheet feed trays 13 by the internal sheet feed rollers 14, to the vertical conveyance rollers 16. The internal sheet feed conveyance rollers 15 are arranged along the internal sheet feed route RS2.

The vertical conveyance rollers 16 convey the sheets P conveyed from the internal sheet feed conveyance rollers 15 along the internal sheet feed route RS2, to the registration rollers 17. Moreover, in the both-side printing, the vertical conveyance rollers 16 convey the sheets P printed on the one sides and conveyed along the circulation route RC, to the registration rollers 17. The vertical conveyance rollers 16 are arranged along the internal sheet feed route RS2, downstream of a point where the circulation route RC merges with the internal sheet feed route RS2.

The registration rollers 17 temporarily stop each of the sheets P conveyed by the external sheet feed rollers 12 or the vertical conveyance rollers 16 to correct skew of the sheet P and then convey the sheet P to a belt platen 21 of the printing unit 3 to be described later. The registration rollers 17 are arranged in the printing route RP, near and downstream of a point where the external sheet feed route RS1 and the internal sheet feed route RS2 merge.

The printing unit 3 prints images on the sheets P while conveying the sheets P. The printing unit 3 is arranged downstream of the sheet feeder 2. The printing unit 3 includes the belt platen 21 and a head unit 22.

The belt platen 21 conveys the sheets P conveyed by the registration rollers 17 while sucking and holding the sheets P by air suction. The belt platen 21 includes a conveyor belt 26, a drive roller 27, driven rollers 28 to 30, and a fan 31.

The conveyor belt 26 conveys the sheets P while sucking and holding the sheets P. The conveyor belt 26 is an annular belt wound around the drive roller 27 and the driven rollers 28 to 30. Many belt holes (not illustrated) are formed in the conveyor belt 26. The conveyor belt 26 sucks and holds the sheets P on a conveyance surface 26*a* by using suction force generated at the belt holes by drive of the fan 31. The conveyance surface 26*a* is an upper surface of the conveyor belt 26 facing inkjet heads 36 to be described later. The conveyor belt 26 conveys the sheets P placed on the conveyance surface 26*a* rightward by rotating clockwise in FIGS. 1 and 2.

The drive roller 27 rotates the conveyor belt 26. The drive roller 27 is rotationally driven by a not-illustrated motor.

The driven rollers 28 to 30 support the conveyor belt 26 together with the drive roller 27. The driven rollers 28 to 30 are driven by the drive roller 27 via the conveyor belt 26. The driven roller 28 is arranged on the left side of the drive roller 27 at the same height. The driven rollers 29 and 30 are arranged at the same height, below the drive roller 27 and the driven roller 28, away from each other in a left-right direction.

The fan 31 generates a downward air flow. The fan 31 thereby sucks air through the belt holes of the conveyor belt 26 and generates negative pressure at the belt holes to suck the sheets P on the conveyance surface 26*a* of the conveyor belt 26. The fan 31 is arranged in a region surrounded by the annular conveyor belt 26.

The head unit 22 prints an image on each sheet P conveyed by the belt platen 21. The head unit 22 includes four inkjet heads 36 and a head holder 37.

The inkjet heads 36 eject inks to the conveyed sheet P. The four inkjet heads 36 are arranged in parallel to one another, to be aligned along a sub-scanning direction (left-right direction) which is the conveying direction of the sheet P. The four inkjet heads 36 eject inks of different colors, respectively. As illustrated in FIG. 3, each of the inkjet heads 36 has six head modules 38. The inkjet heads 36 are immobile, for example, with respect to the printing route RP, that is the inkjet heads 36 are fixed inkjets which do not move in the printing of the sheet P.

The head modules 38 each have multiple nozzles 39 open on a lower surface of the head module 38 which is a surface facing the conveyance surface 26*a* of the conveyor belt 26, and eject inks from the nozzles 39. The nozzles 39 are aligned in the main scanning direction (front-rear direction) orthogonal to the conveying direction of the sheet P.

In each of the inkjet heads 36, the head modules 38 are arranged in zigzag in the main scanning direction. Specifically, in each inkjet head 36, the six head modules 38 arranged in the main scanning direction are arranged to be alternately offset from one another in the sub-scanning direction.

The head holder 37 holds the inkjet heads 36. The head holder 37 is formed in a rectangular solid shape which is hollow. The head holder 37 is arranged above the belt platen 21. The head holder 37 holds the head modules 38 of the inkjet heads 36 such that lower end portions of the head modules 38 protrude downward from a bottom surface 37*a* of the head holder 37.

The circulation conveyor 4 conveys the sheets P printed on the one sides along the circulation route RC and transfers the sheets P to the vertical conveyance rollers 16 in the both-side printing. The circulation route RC is a route which extends downward from a downstream end of the printing route RP, passes below the belt platen 21, and merges with the internal sheet feed route RS2 near a position upstream of the vertical conveyance rollers 16. The circulation conveyor 4 includes two pairs of intermediate conveyance rollers 41, switchback rollers 42, and four pairs of horizontal conveyance rollers 43.

The intermediate conveyance rollers 41 receives the sheets P printed on one sides from the belt platen 21 and conveys the sheets P to the switchback rollers 42 in the both-side printing. The two pairs of intermediate conveyance rollers 41 are arranged in a downward conveyance section of the circulation route RC in an upstream portion thereof.

The switchback rollers 42 switch back the sheets P conveyed by the intermediate conveyance rollers 41 and convey the sheets P to the horizontal conveyance rollers 43. The switchback rollers 42 are arranged in the circulation route RC, downstream of the intermediate conveyance rollers 41.

The horizontal conveyance rollers 43 convey the sheets P switched back by the switchback rollers 42, to the vertical conveyance rollers 16. The three pairs of horizontal conveyance rollers 43 on the upstream side are arranged in a horizontal section of the circulation route RC below the belt platen 21. The most downstream pair of horizontal conveyance rollers 43 is arranged in an upward conveyance section of the circulation route RC downstream of the horizontal section.

The sheet discharger 5 discharges the printed sheets P. The sheet discharger 5 is arranged downstream of the printing unit 3. The sheet discharger 5 includes an inner sheet discharge guide plate 46, an outer sheet discharge guide plate 47, an adjustment member 48, a blocking member 49, three pairs of sheet discharge rollers 50, and a sheet receiving tray 51. Note that the inner sheet discharge guide plate 46, the outer sheet discharge guide plate 47, the adjustment member 48, and the most upstream pair of sheet discharge rollers 50 form a downstream side conveyor. Moreover, the inner sheet discharge guide plate 46 and the outer sheet discharge guide plate 47 form a guide.

The inner sheet discharge guide plate 46 and the outer sheet discharge guide plate 47 guide the sheets P such that the sheets P travel upward from a downstream end of the printing route RP while curving. The inner sheet discharge guide plate 46 and the outer sheet discharge guide plate 47 are formed in a curved shape protruding toward the lower right side. The inner sheet discharge guide plate 46 and the outer sheet discharge guide plate 47 are arranged near and downstream of the printing unit 3 while being spaced away from each other. The inner sheet discharge guide plate 46 is arranged on the inner side of the curve and the outer sheet discharge guide plate 47 is arranged on the outer side of the curve. The sheets P are conveyed inside a space between the inner sheet discharge guide plate 46 and the outer sheet discharge guide plate 47. This space forms an upstream portion (downstream conveyance route) of the sheet discharge route RD.

Note that not-illustrated guide plates are provided downstream of the inner sheet discharge guide plate 46 and the outer sheet discharge guide plate 47.

Multiple communication holes 46*a* are formed in the inner sheet discharge guide plate 46. The sheet discharge route RD and an air buffer 56 are in communication with each other via the communication holes 46*a*. The communication holes 46*a* are arranged near and downstream of the adjustment member 48 to be aligned in the front-rear direction. The air buffer 56 is a space between the head holder 37 and the inner sheet discharge guide plate 46 and is a space outside the printing route RP and the sheet discharge route RD. Since there is no generation source of ink mist in the air buffer 56, the air buffer 56 is a region with low ink mist density.

A sensor opening 46*b* is formed in the inner sheet discharge guide plate 46. A sensor attachment portion 46*c* is formed near the sensor opening 46*b* of the inner sheet discharge guide plate 46. A sheet sensor 57 is attached to the sensor attachment portion 46*c*. The sheet sensor 57 detects the sheets P conveyed along the sheet discharge route RD, through the sensor opening 46*b*. A detection result of the sheet P obtained by the sheet sensor 57 is used for detection of sheet jam and the like. Note that not-illustrated sheet sensors other than the sheet sensor 57 are arranged at appropriate positions in the inkjet printer 1.

The adjustment member 48 is a member which narrows a flow path of air in the sheet discharge route RD. The adjustment member 48 is arranged on a lower surface (surface on the outer sheet discharge guide plate 47 side) of the inner sheet discharge guide plate 46, near an upstream end of the inner sheet discharge guide plate 46 (sheet discharge route RD). The adjustment member 48 is formed in a shape elongating in the front-rear direction. For example, the adjustment member 48 extends, near the upstream end of the sheet discharge route RD, in the front-rear direction and the up-down direction such that the area of an opening cross section of the sheet discharge route RD orthogonal to the sheet conveying direction (left-right direction) is reduced. The adjustment member 48 is made of resin, sponge, or the like.

The blocking member 49 is a member separating a head holder lower space 58 and the air buffer 56 from each other.

The head holder lower space 58 is a space between the bottom surface 37*a* of the head holder 37 and the conveyance surface 26*a* of the conveyor belt 26. The head holder lower space 58 forms part of the printing route RP. The head holder lower space 58 is a region in which ink mist exists at high density in the printing.

The blocking member 49 is formed in a square columnar shape elongating in the front-rear direction. The blocking member 49 is arranged on an upper surface of an upstream end portion of the inner sheet discharge guide plate 46. An upper surface of the blocking member 49 is in contact with the bottom surface 37*a* of the head holder 37. The head holder lower space 58 (printing route RP) and the air buffer 56 are thereby separated from each other, and flow-out of the ink mist from the head holder lower space 58 to the air buffer 56 is suppressed. The blocking member 49 is made of resin, sponge, or the like.

The sheet discharge rollers 50 discharge the sheets P conveyed from the belt platen 21 to the sheet receiving tray 51. Three pairs of the sheet discharge rollers 50 are arranged in the sheet discharge route RD.

Note that the sheet discharger 5 is provided with a not-illustrated flipper. The flipper can switch a conveyance destination of each sheet P from the belt platen 21, between the circulation route RC and the sheet discharge route RD.

The sheet receiving tray 51 is a tray on which the sheets P discharged by the sheet discharge rollers 50 are stacked. The sheet receiving tray 51 is arranged at a downstream end of the sheet discharge route RD.

Next, operations of the inkjet printer 1 are described.

In the case of performing the printing, first the sheet feeder 2 picks up a sheet P from one of the external sheet feed tray 11 and the internal sheet feed trays 13 and feeds the sheet P to the printing unit 3. The printing unit 3 prints an image on the sheet P by ejecting the inks from the inkjet head 36 while conveying the sheet P with the belt platen 21.

In the one-side printing, the sheet P is conveyed by the belt platen 21 and is guided to the sheet discharge route RD by the not-illustrated flipper. The sheet discharger 5 conveys the sheet P guided to the sheet discharge route RD with the sheet discharge rollers 50 and discharges the sheet P to the sheet receiving tray 51.

Meanwhile, in the both-side printing, the sheet P is guided to the circulation route RC by the not-illustrated flipper while being conveyed by the belt platen 21. The circulation conveyor 4 conveys the sheet P printed on one side and guided to the circulation route RC, to the switchback rollers 42 with the intermediate conveyance rollers 41, and switches back the sheet P with the switchback rollers 42. Then the circulation conveyor 4 conveys the switched-back sheet P to the vertical conveyance rollers 16 with the horizontal conveyance rollers 43. The vertical conveyance rollers 16 convey the sheet P to the registration rollers 17 and the registration rollers 17 refeed the sheet P to the printing unit 3.

In this case, since the sheet P printed on one side is switched back by the switchback rollers 42, the sheet P is refed to the printing unit 3 with an unprinted surface facing upward. The printing unit 3 prints an image on the unprinted surface of the sheet P by ejecting the inks from the inkjet heads 36 while conveying the sheet P with the belt platen 21. Thereafter, the sheet P is guided to the sheet discharge route RD and is discharged by the sheet discharger 5.

In the case of performing the one-side printing of multiple sheets, the sheet feeder 2 feeds the multiple sheets P one by one at such timings that the sheets P are conveyed at predetermined sheet intervals in the printing unit 3. The sheets P fed one by one are subjected to the printing while being conveyed at the predetermined sheet intervals in the printing unit 3, and are discharged one by one by the sheet discharger 5.

In the case of performing the both-side printing of multiple sheets, the sheet feeder 2 feeds the unprinted sheets P one by one at such timings that a time between the sheet feeding timings of the sheets P is twice as that in the one-side printing. Moreover, the sheet feeder 2 refeeds the sheet P printed on one side and conveyed by the circulation conveyor 4 by inserting the sheet P between the unprinted sheets P. The printing unit 3 alternately performs the printing on the one side of the unprinted sheet P and the printing on the unprinted side of the sheet P printed on one side. The both-side printing is thereby performed at productivity for one side equivalent to that in the one-side printing. The sheets P printed on both sides are discharged one by one by the sheet discharger 5.

In the printing operations described above, ink mist is generated in the head holder lower space 58 due to the ejection of the inks from the inkjet heads 36. Although part of the generated ink mist is sucked into the belt platen 21 through the belt holes of the conveyor belt 26, the rest of the ink mist exists in the head holder lower space 58. In the head holder lower space 58, an air flow in the conveying direction is generated by the belt platen 21 conveying the sheets P, and this air flow contains a large amount of ink mist.

Figure 5:
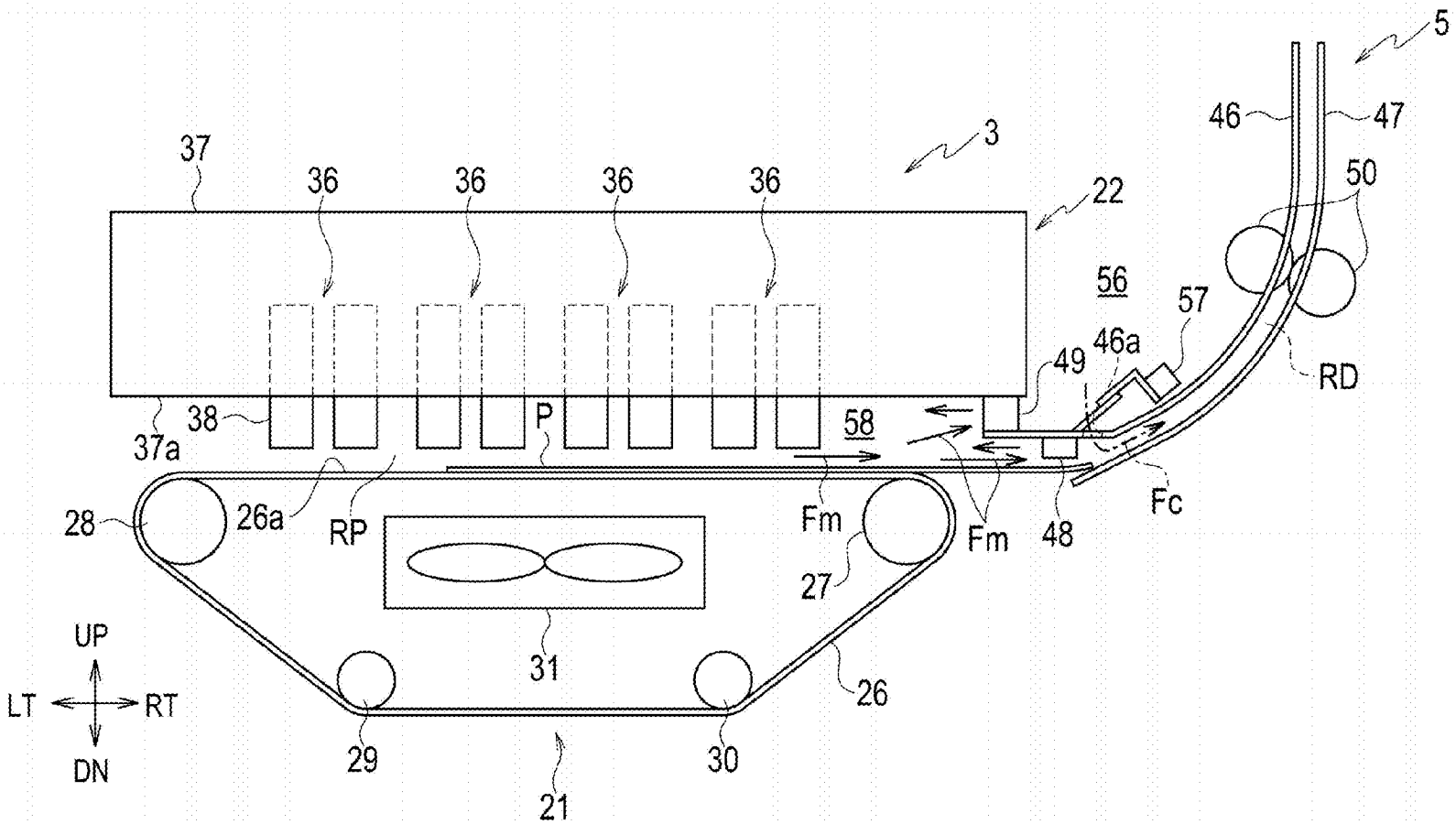
FIG. 5 is an explanatory view of an air flow in the printing unit and the sheet discharger.

As illustrated in FIG. 5, the air flow Fm generated in the head holder lower space 58 and containing a large amount of ink mist flows toward the sheet discharge route RD. However, since the adjustment member 48 is arranged near the upstream end of the sheet discharge route RD, part of the air flow Fm is blocked by the adjustment member 48.

Meanwhile, in a portion downstream of the adjustment member 48, an air flow Fc flowing from the air buffer 56 to the sheet discharge route RD through the communication holes 46*a* is generated. The air flow Fc causes the air to flow into the sheet discharge route RD from the air buffer 56 and this can suppress air flowing into the sheet discharge route RD from the head holder lower space 58.

Accordingly, it is possible to reduce the amount of air whose ink mist density is high and which flows into the sheet discharge route RD from the head holder lower space 58. Moreover, since the air velocity of the air flow Fm in the head holder lower space 58 can be reduced, the generation amount of the ink mist can be reduced.

Moreover, since the blocking member 49 blocks the air flow Fm flowing from the head holder lower space 58 to the air buffer 56, the flowing-in of the ink mist into the air buffer 56 is suppressed. The air buffer 56 is thereby maintained in a low ink mist density state. This suppresses the case where the ink mist flows into the sheet discharge route RD due to the air flow Fc flowing from the air buffer 56 to the sheet discharge route RD.

Accordingly, it is possible to reduce the ink mist which flows into the sheet discharge route RD and adheres to the inner sheet discharge guide plate 46 and the outer sheet discharge guide plate 47.

Moreover, since the amount of ink mist adhering to the sheet sensor 57 can be also reduced, erroneous detection of the sheet P by the sheet sensor 57 can be reduced. Erroneous operations of the inkjet printer 1 can be thereby reduced.

Next, description is given of results of simulation of an air flow in the sheet conveyance from the printing unit 3 to the sheet discharger 5.

Figure 6:
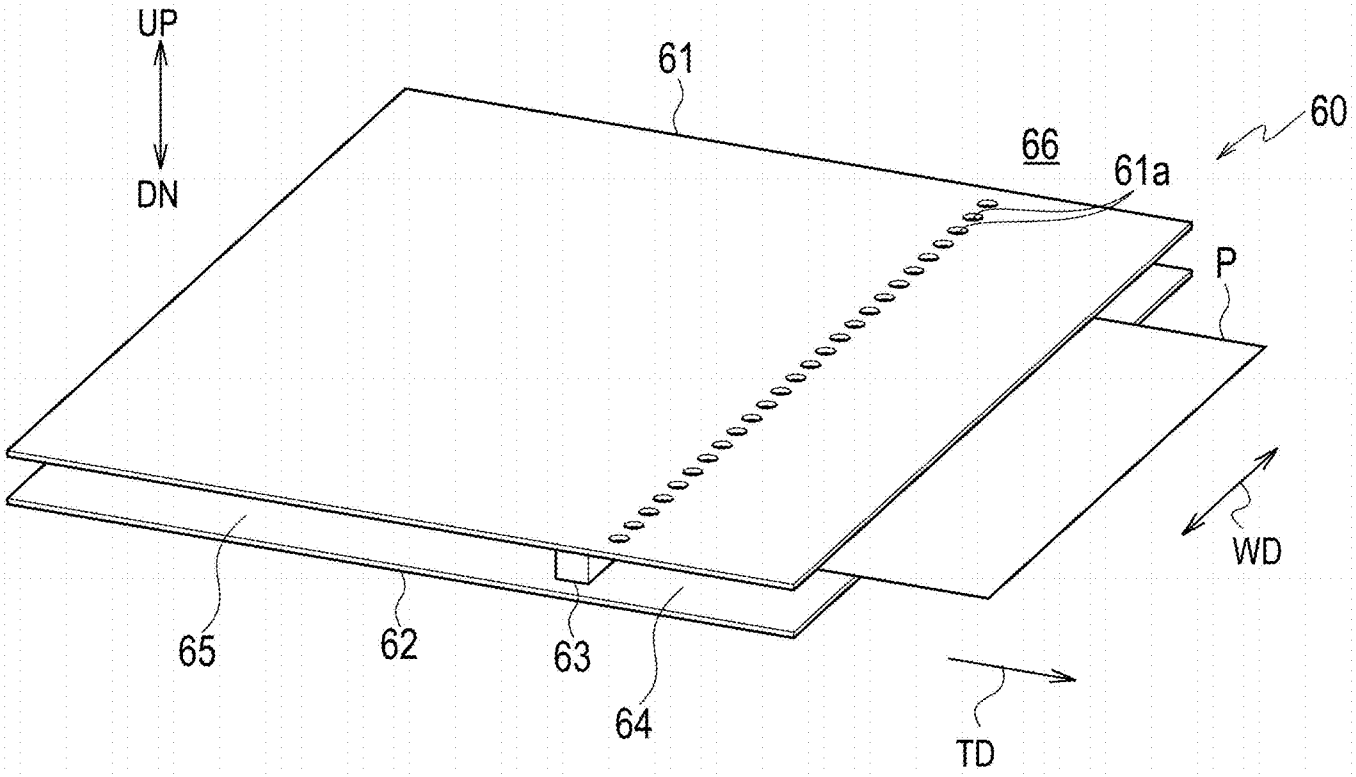
FIG. 6 is an explanatory view of an analysis model used in simulation of an air flow from the printing unit to the sheet discharger which is generated by sheet conveyance.

FIG. 6 is an explanatory view of an analysis model used in this simulation. As illustrated in FIG. 6, this analysis model 60 includes a pair of guide plates 61, 62 and an adjustment member 63.

The guide plates 61, 62 are arranged in parallel to each other at a predetermined interval in the up-down direction. The sheet P is conveyed inside a space between the guide plates 61, 62. Multiple communication holes 61*a* are formed in the guide plate 61. The space between the guide plates 61, 62 and a space above the guide plate 61 are in communication with each other via the communication holes 61*a*. The multiple communication holes 61*a* are arranged near and downstream of the adjustment member 63 in the conveying direction of the sheet P to be aligned in the sheet width direction.

The adjustment member 63 is arranged on a lower surface of the upper guide plate 61. The length of the adjustment member 63 in the sheet width direction is the same as that of the guide plate 61. The height of the adjustment member 63 is smaller than the interval between the guide plates 61, 62.

Portions of the guide plates 61, 62 of the analysis model 60 downstream of an upstream end of the adjustment member 63 correspond to the inner sheet discharge guide plate 46 and the outer sheet discharge guide plate 47 of the inkjet printer 1, respectively. A space 64 between portions of the guide plates 61, 62 downstream of the upstream end of the adjustment member 63 corresponds to the sheet discharge route RD of the inkjet printer 1.

The communication holes 61*a* in the guide plate 61 of the analysis model 60 correspond to the communication holes 46*a* in the inner sheet discharge guide plate 46 of the inkjet printer 1. The adjustment member 63 of the analysis model 60 corresponds to the adjustment member 48 of the inkjet printer 1.

A space 65 between portions of the guide plates 61, 62 upstream of the upstream end of the adjustment member 63 in the analysis model 60 corresponds to the head holder lower space 58 of the inkjet printer 1. A space 66 above the guide plate 61 in the analysis model 60 corresponds to the air buffer 56 of the inkjet printer 1.

The simulation is performed under each of three conditions of a condition 1 to a condition 3.

The condition 1 is a condition in which there are no adjustment member 63 or communication holes 61*a* in the analysis model 60 of FIG. 6. In other words, an analysis model omitting the adjustment member 63 and the communication holes 61*a* from the analysis model 60 of FIG. 6 is used in the condition 1.

The condition 2 is a condition in which there are no communication holes 61*a* in the analysis model 60 of FIG. 6 but there is the adjustment member 63. In other words, an analysis model omitting the communication holes 61*a* from the analysis model 60 of FIG. 6 is used in the condition 2.

The condition 3 is a condition in which there are the adjustment member 63 and the communication holes 61*a* as in the analysis model 60 of FIG. 6. In other words, the analysis model 60 of FIG. 6 is used in the condition 3.

Figure 7:
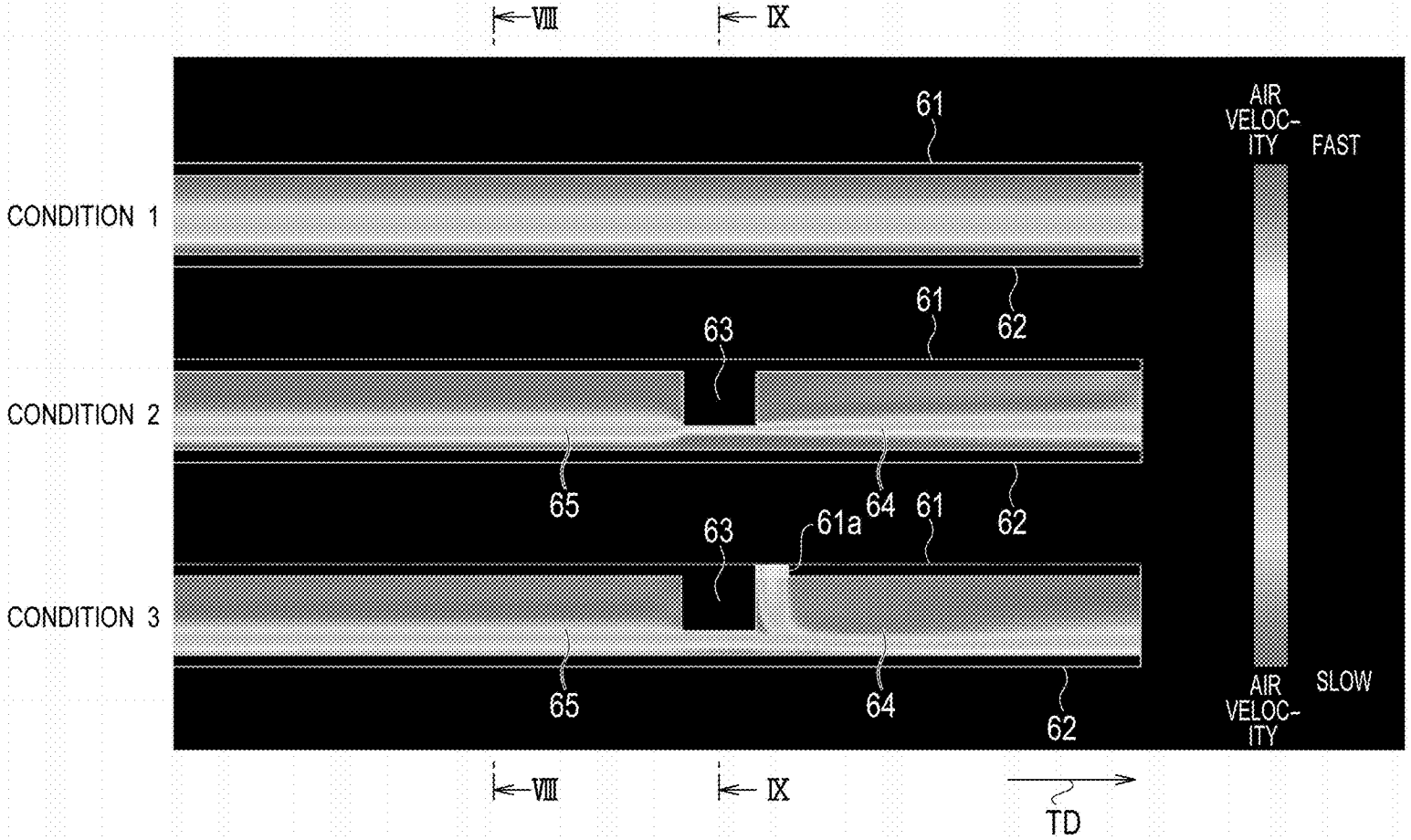
FIG. 7 illustrates analysis results of air velocity distribution in the simulation.
Figure 8:
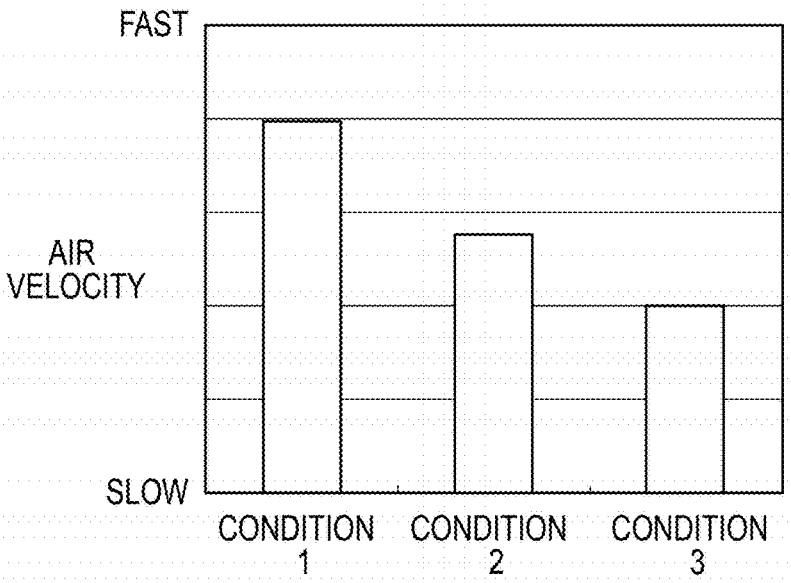
FIG. 8 is a graph depicting average air velocities at a cross section along the line VIII-VIII in FIG. 7.
Figure 9:
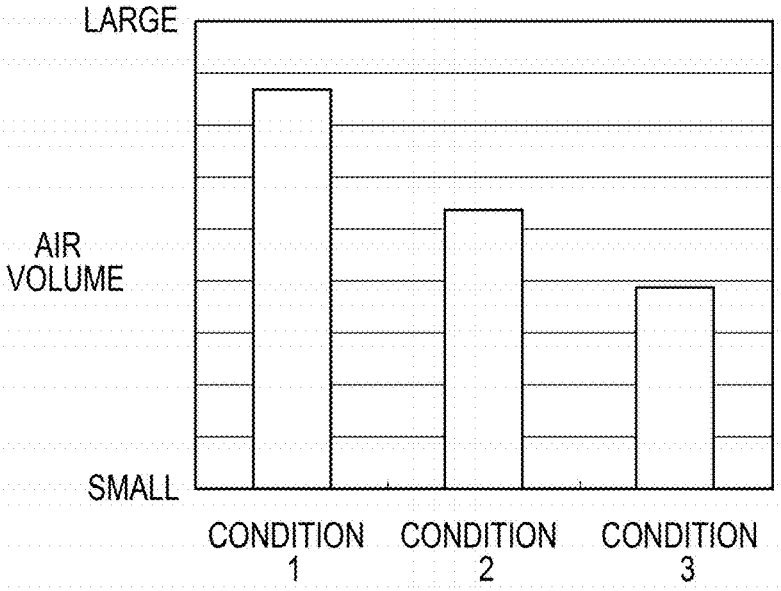
FIG. 9 is a graph depicting average air volumes at a cross section along the line IX-IX in FIG. 7.
Figure 10:
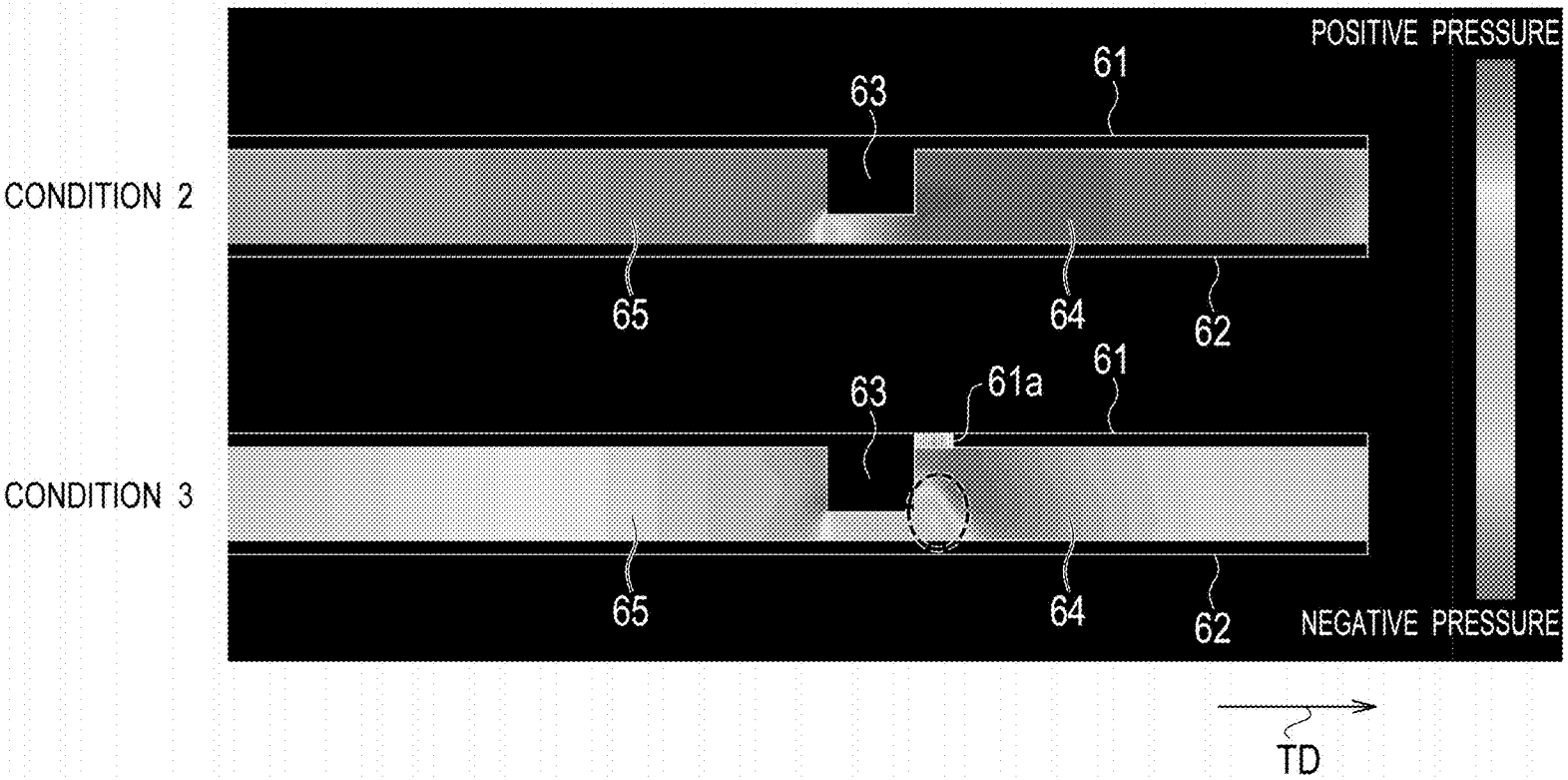
FIG. 10 is view illustrating analysis results of pressure distribution in the simulation.

The results of the simulation are illustrated in FIGS. 7 to 9. FIG. 7 illustrates analysis results of air velocity distribution in the simulation under the conditions 1 to 3. FIG. 8 is a graph depicting average air velocities under the conditions 1 to 3 at a cross section along the line VIII-VIII in FIG. 7. FIG. 9 is a graph depicting average air volumes under the conditions 1 to 3 at a cross section along the line IX-IX in FIG. 7. FIG. 10 is view illustrating analysis results of pressure distribution in the simulation under the conditions 2 and 3.

Comparing the condition 1 and the condition 2, as depicted in FIGS. 7 to 9, the air velocity at the cross section along the line VIII-VIII and the air volume at the cross section along the line IX-IX in the condition 2 are reduced compared to those in the condition 1. This is due to the effect of the adjustment member 63 blocking the air flow.

In this case, the line VIII-VIII is located upstream of the adjustment member 63. The reduction of the air velocity at the cross section along the line VIII-VIII corresponds to reduction of the air velocity in the head holder lower space 58 of the inkjet printer 1. As the air velocity in the head holder lower space 58 decreases, the generation amount of the ink mist decreases.

Moreover, the line IX-IX is a line passing through the adjustment member 63. The reduction of the air velocity at the cross section along the line IX-IX corresponds to reduction of the amount of air flowing into the sheet discharge route RD from the head holder lower space 58 of the inkjet printer 1. As the amount of air flowing into the sheet discharge route RD from the head holder lower space 58 decreases, the amount of ink mist flowing into the sheet discharge route RD decreases.

Next, comparing the condition 2 and the condition 3, the air velocity at the cross section along the line VIII-VIII and the air volume at the cross section along the line IX-IX in the condition 3 are further reduced compared to those in the condition 2. The reason for this is described with reference to FIG. 10.

As illustrated in an upper portion (condition 2) of FIG. 10, positive pressure is generated by a conveyance air flow, upstream of the upstream end of the adjustment member 63 (space 65), and negative pressure is generated downstream of the upstream end of the adjustment member 63 (space 64). Force of the space 64 sucking air from the space 65 is thereby generated.

Meanwhile, in the condition 3, air flows into the space 64 from the space 66 via the communication holes 61*a*. As illustrated in a lower portion of FIG. 10, the negative pressure is thereby eliminated in a portion near a downstream end of the adjustment member 63 (portion surrounded by a broken line). The force of the space 64 sucking air from the space 65 thus decreases. As a result, the air velocity at the cross section along the line VIII-VIII and the air volume at the cross section along the line IX-IX in the condition 3 are reduced compared to those in the condition 2.

From the results of the simulation described above, it is found that the air velocity in the head holder lower space 58 and the amount of air flowing into the sheet discharge route RD from the head holder lower space 58 are reduced by the adjustment member 48 and the communication holes 46*a* in the inkjet printer 1.

As described above, in the inkjet printer 1, the sheet discharger 5 has the adjustment member 48 narrowing the flow passage of air in the sheet discharge route RD. Moreover, the communication holes 46*a* which are arranged downstream of the adjustment member 48 and via which the sheet discharge route RD and the air buffer 56 communicate are in communication with each other are formed in the inner sheet discharge guide plate 46. The air velocity in the head holder lower space 58 and the amount of air flowing into the sheet discharge route RD from the head holder lower space 58 can be thereby reduced. This can reduce the generation amount of the ink mist and suppress the flow of the ink mist into the sheet discharge route RD. As a result, it is possible to reduce the amount of ink mist adhering to the inner sheet discharge guide plate 46 and the outer sheet discharge guide plate 47 and to thus reduce smears on printed sheets.

Moreover, since there is no need to provide mechanism for collecting the ink mist such as a fan in the inkjet printer 1, an increase in size of the apparatus can be suppressed.

Hence, the inkjet printer 1 can reduce smears on printed sheets with an increase in size of the apparatus being suppressed.

Figure 12:
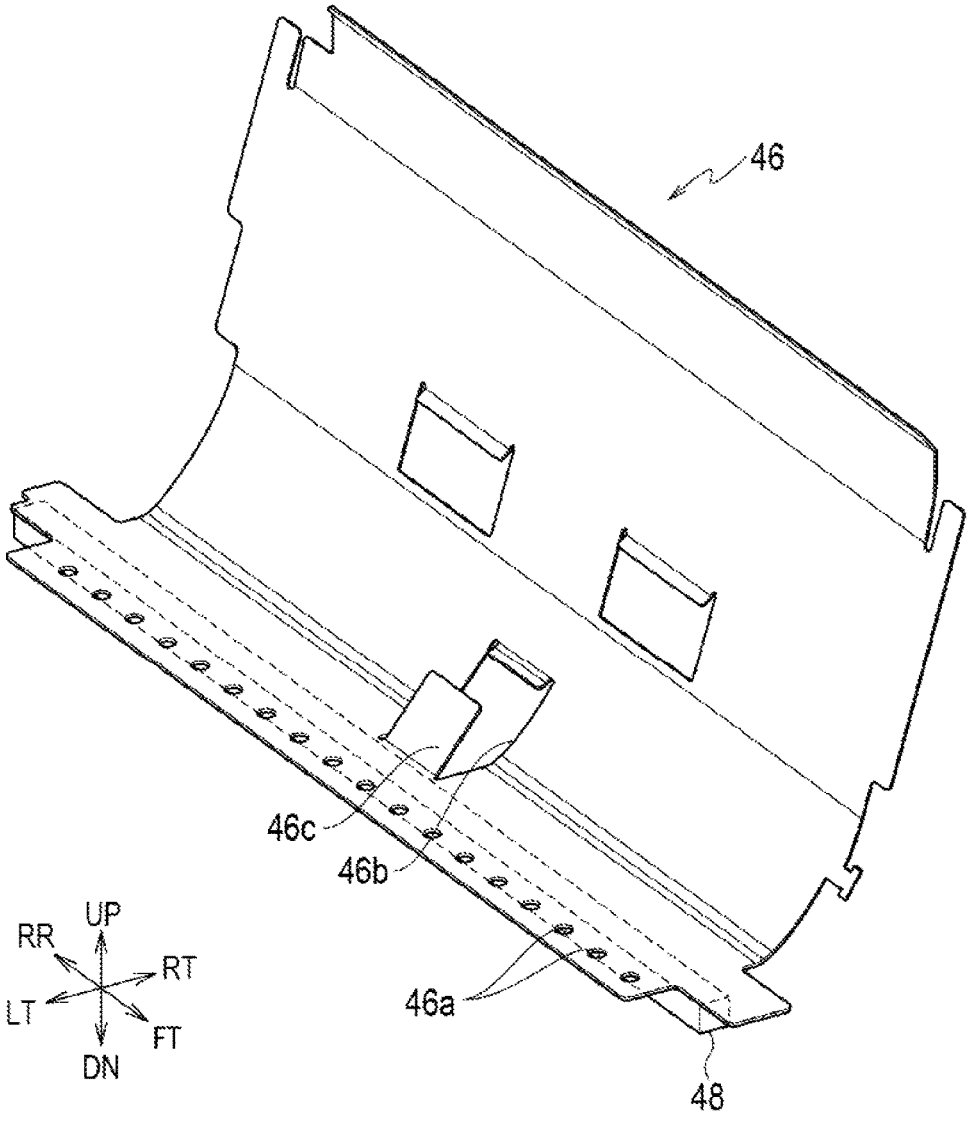
FIG. 12 is a perspective view similar to FIG. 4 but with the communications holes upstream of the adjustment member.

Note that the configuration may be such that the communication holes 46*a* are formed upstream of the adjustment member 48 as illustrated in Fig. 12. In this case, air in the head holder lower space 58 including the ink mist flows out to the air buffer 56 via the communication holes 46*a*. Accordingly, the flow of the ink mist into the sheet discharge route RD can be suppressed.

Second Embodiment

Figure 11:
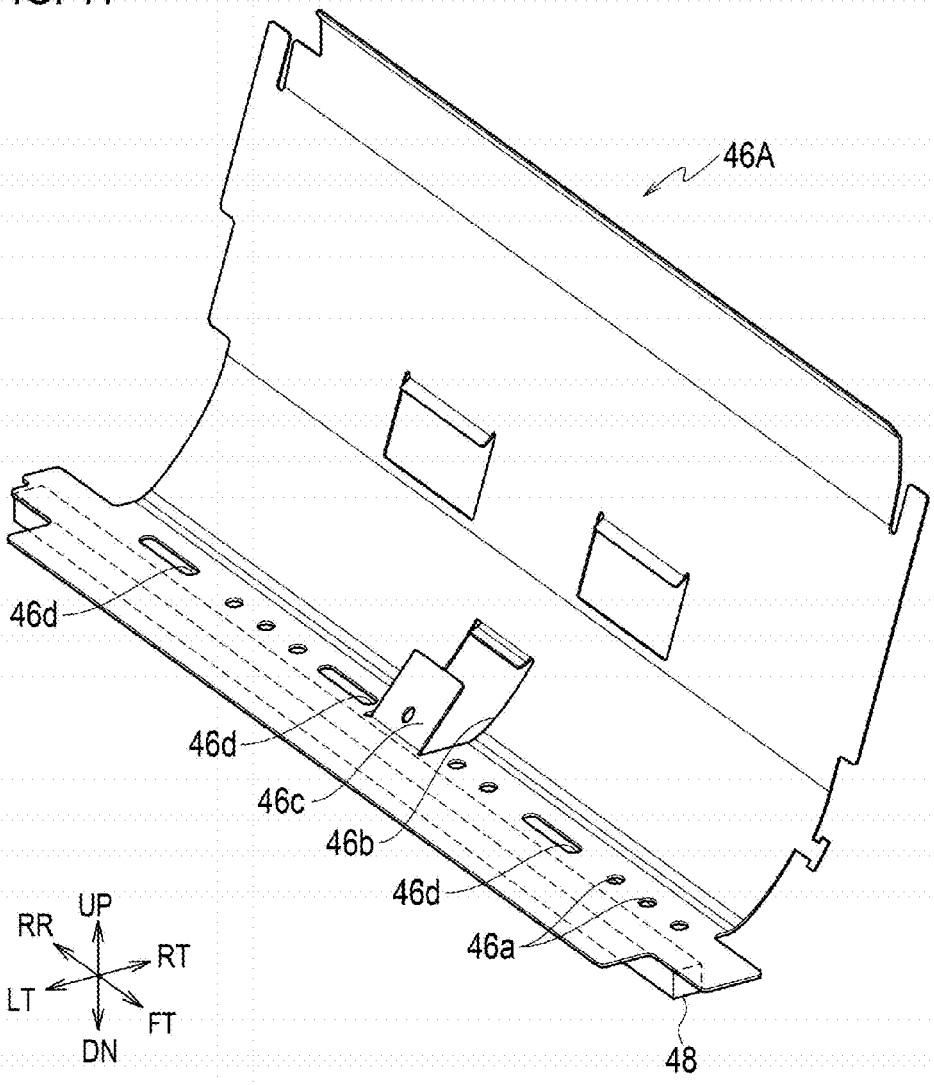
FIG. 11 is a perspective view of an inner sheet discharge guide plate in a second embodiment.

Description is given of a second embodiment in which the inner sheet discharge guide plate of the aforementioned embodiment is changed. FIG. 11 is a perspective view of an inner sheet discharge guide plate in the second embodiment.

As illustrated in FIG. 11, the inner sheet discharge guide plate 46A in the second embodiment has a configuration in which some of the multiple communication holes 46*a* in the inner sheet discharge guide plate 46 of the first embodiment described above are replaced by communication holes 46*d*.

The communication holes 46*d* have a larger opening area than the communication holes 46*a*. The communication holes 46*d* are located in regions downstream of the head modules 38 arranged on the downstream side out of the head modules 38 arranged in zigzag. In other words, the communication holes 46*d* are located closer to the head modules 38 in the conveyance direction of the sheet P (sub-scanning direction) than the communication holes 46*a* are.

In the head holder lower space 58, as the ink mist flows downstream from the head modules 38, the ink mist is further agitated in the air and the density of the ink mist decreases. Accordingly, the density of the ink mist reaching the adjustment member 48 is higher in regions close to the head modules 38 than in regions far from the head modules 38. Specifically, the density of the ink mist reaching the adjustment member 48 in the regions downstream of the head modules 38 on the downstream side is higher than that in regions downstream of the head modules 38 on the upstream side.

Meanwhile, in the inner sheet discharge guide plate 46A of the second embodiment, the communication holes 46*d* in the regions downstream of the head modules 38 on the downstream side are larger than the communication holes 46*a*. Accordingly, in the regions downstream of the head modules 38 on the downstream side, more air can be made to flow into the sheet discharge route RD from the air buffer 56. This can suppress the case where air containing ink mist at high density flows into the sheet discharge route RD from the head holder lower space 58. As a result, the flow of ink mist into the sheet discharge route RD can be further suppressed, and smears on printed sheets can be further reduced.

Figure 13:
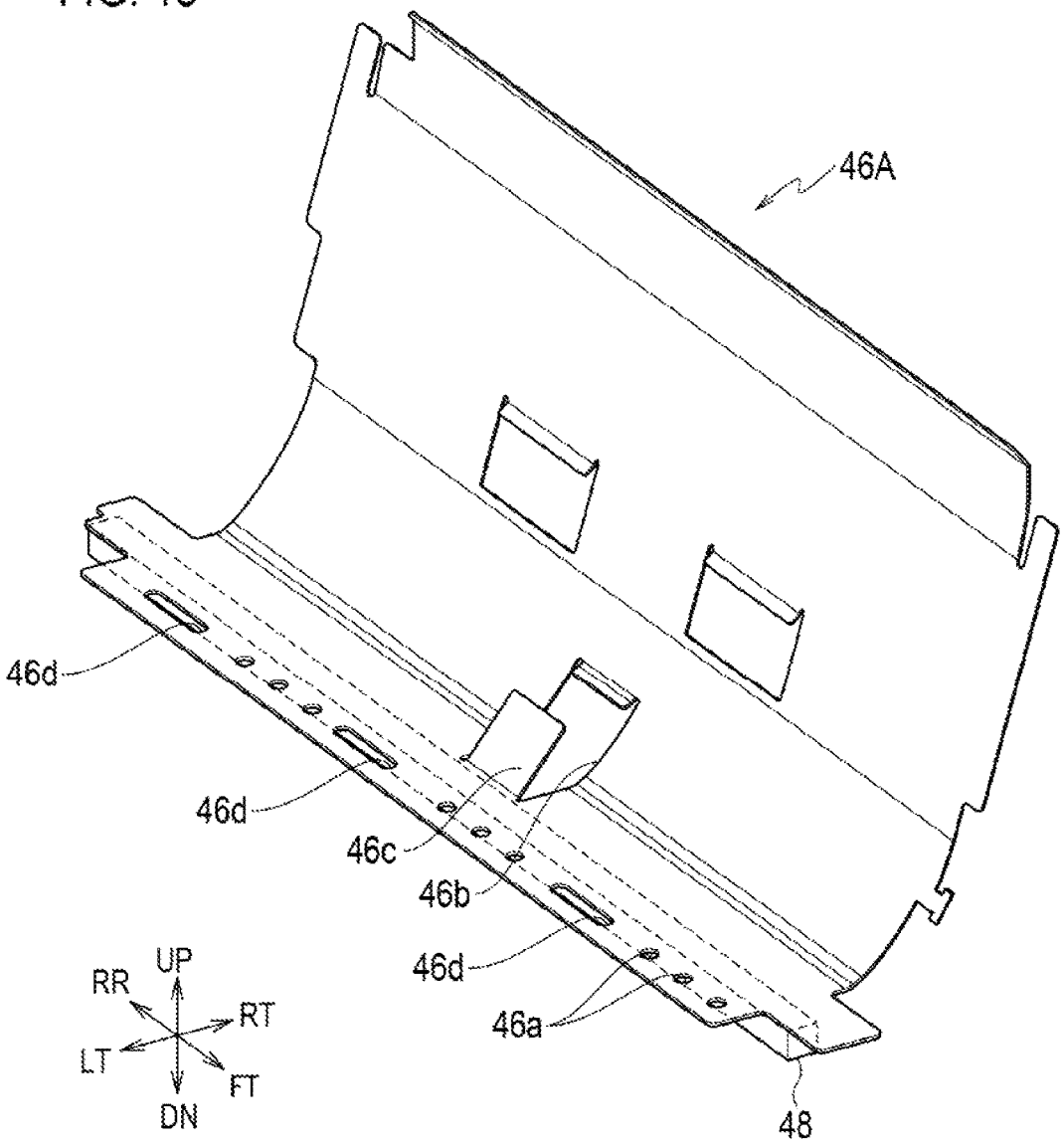
FIG. 13 is a perspective view similar to FIG. 11 but with the communications holes upstream of the adjustment member.

Note that the communication holes 46*a*, 46*d* may be formed upstream of the adjustment member 48 also in the second embodiment as in the first embodiment as illustrated in FIG. 13. In this case, since air containing the ink mist in the head holder lower space 58 flows out to the air buffer 56 via the communication holes 46*a*, 46*d* as in the first embodiment also in the second embodiment, the flow of the ink mist into the sheet discharge route RD can be suppressed. In the second embodiment, since air in the regions where air contains ink mist at high density flows out from the head holder lower space 58 via the communication holes 46*d*, the flow of the ink mist into the sheet discharge route RD can be further suppressed compared to that in case where the opening areas of the respective communication holes are the same.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a printing unit comprising an inkjet head and configured to eject an ink from the inkjet head while conveying a sheet in a conveying direction along a printing route to perform printing on the sheet; and a downstream side sheet conveyor arranged downstream of the printing unit in the conveying direction and comprising a sheet guide defining a downstream sheet conveyance route being a space for the sheet to be conveyed, the downstream side sheet conveyor configured to convey the sheet along the downstream sheet conveyance route, wherein the downstream side sheet conveyor comprises an adjustment member that protrudes from the sheet guide into the downstream sheet conveyance route narrowing a flow passage of air in the downstream sheet conveyance route, the sheet guide comprises communication holes communicating the downstream sheet conveyance route with a space outside the printing route and outside the downstream sheet conveyance route.

2. The inkjet printer according to claim 1, wherein the communication holes are arranged downstream of the adjustment member in the conveying direction.

3. The inkjet printer according to claim 1, wherein the inkjet head comprises a plurality of head modules, and a communication hole of the communication holes located closer to the plurality of head modules in the conveying direction than the other communication hole has a larger opening area than an opening area of the other communication hole.

4. The inkjet printer according to claim 2, wherein the inkjet head comprises a plurality of head modules, and a communication hole of the communication holes located closer to the plurality of head modules in the conveying direction than the other communication hole has a larger opening area than an opening area of the other communication hole.

5. The inkjet printer according to claim 1, wherein the adjustment member extends in the direction orthogonal to the conveying direction to reduce an area of an opening cross section of the downstream sheet conveyance route taken in the direction orthogonal to the conveying direction.

6. The inkjet printer according to claim 2, wherein the adjustment member extends in the direction orthogonal to the conveying direction to reduce an area of an opening cross section of the downstream sheet conveyance route taken in the direction orthogonal to the conveying direction.

7. The inkjet printer according to claim 3, wherein the adjustment member extends in the direction orthogonal to the conveying direction to reduce an area of an opening cross section of the downstream sheet conveyance route taken in the direction orthogonal to the conveying direction.

8. The inkjet printer according to claim 1, wherein the inkjet head is a fixed inkjet head.

9. The inkjet printer according to claim 2, wherein the inkjet head is a fixed inkjet head.

10. The inkjet printer according to claim 3, wherein the inkjet head is a fixed inkjet head.

11. The inkjet printer according to claim 1, wherein the adjustment member is arranged at an upstream end of the downstream sheet conveyance route and configured to block part of an air flow generated in a lower space of the inkjet head by the sheet being conveyed by the printing unit, containing ink mist, and flowing toward the downstream sheet conveyance route, the communication holes are arranged downstream or upstream of the adjustment member in the conveying direction, with the communication holes arranged downstream of the adjustment member in the conveying direction, the adjustment member and the sheet being conveyed by the printing unit generate an air flow flowing from the space outside the printing route and outside the downstream sheet conveyance route to the downstream sheet conveyance route through the communication holes, and the generated air flow causes air to flow into the downstream sheet conveyance route from the space outside the printing route and outside the downstream sheet conveyance route, and with the communication holes arranged upstream of the adjustment member in the conveying direction, the part of air flow blocked by the adjustment member causes air in the lower space of the inkjet head containing the ink mist to flow out to the space outside the printing route and outside the downstream sheet conveyance route via the communication holes.

12. The inkjet printer according to claim 1, wherein the printing unit comprises a belt platen configured to convey the sheet while sucking and holding the sheet by air suction.

13. The inkjet printer according to claim 1, wherein the conveying direction is perpendicular to a direction of ink ejection from the inkjet head, the adjustment member extends in a direction orthogonal to the conveying direction, and the communication holes are aligned in the direction orthogonal to the conveying direction.

14. The inkjet printer according to claim 1, wherein the adjustment member extends in a width direction of the sheet being conveyed at the adjustment member, and the communication holes are aligned in the width direction of the sheet being conveyed at the communication holes.

* * * * *